United States Patent [19]

McNair

[11] 3,997,083

[45] Dec. 14, 1976

[54] SHAVING LATHER HEATER AND DISPENSER HAVING HEAT STORING ELEMENT

[75] Inventor: Samuel L. McNair, Overland Park, Kans.

[73] Assignee: Dazey Products Company, Kansas City, Mo.

[22] Filed: Oct. 24, 1974

[21] Appl. No.: 517,772

Related U.S. Application Data

[63] Continuation-in-part of Ser. No. 488,892, July 15, 1974, abandoned.

[52] U.S. Cl. ..... 222/146 HA; 219/297; 219/306; 222/146 HE

[51] Int. Cl.[2] ..... B67D 5/62

[58] Field of Search ..... 219/214, 296, 297, 298, 219/299, 306; 222/146 HA, 146 HE, 70

[56] References Cited

UNITED STATES PATENTS

| | | | |
|---|---|---|---|
| 2,226,250 | 12/1940 | Mayer | 219/214 |
| 3,335,910 | 8/1967 | Rossi | 219/214 X |
| 3,338,476 | 8/1967 | Marcoux | 219/214 X |
| 3,372,840 | 3/1968 | Kelley | 219/306 X |
| 3,588,469 | 6/1971 | Dillarstone | 222/146 HA |
| 3,644,707 | 2/1972 | Costello | 222/146 HA |
| 3,823,851 | 7/1974 | Waters | 222/146 HA |

*Primary Examiner*—Robert B. Reeves
*Assistant Examiner*—David A. Scherbel
*Attorney, Agent, or Firm*—Lowe, Kokjer, Kircher, Wharton & Bowman

[57] ABSTRACT

A non-metallic housing is provided with an inlet adapted to be coupled with the discharge valve stem of an aerosol type lather container. The inlet communicates with a heating chamber within the housing formed by two concentric aluminum tubes contained within a sleeve formed on the inside of the housing. The tubes are heated by a heat storing electric resistance heating element located within the inner tube. Blade conductors are embedded in and extend from the outside wall of the housing for connection with a conventional wall electric outlet. The blades are connected with the heating element through a circuit which includes a timing switch which limits the time interval during which the heating element is energized. Once energized and raised to operating temperature, the unit is removed from the wall outlet, placed on the valve stem of the container to depress same, whereupon lather flows in through the inlet, through the chamber and a baffled steam trap, and is dispensed through an outlet formed in the housing. A check valve in the inlet passageway prevents reverse flow at times when the valve stem is not engaged. The timing switch comprises a blade thermostat remote from the heating element and a resistor in heat transfer relationship with the thermostat.

4 Claims, 4 Drawing Figures

SHAVING LATHER HEATER AND DISPENSER HAVING HEAT STORING ELEMENT

RELATED APPLICATION

This application is a continuation-in-part of my application Ser. No. 488,892, filed July 15, 1974, titled "SHAVING LATHER HEATER AND DISPENSER", now abandoned.

BACKGROUND AND SUMMARY OF THE INVENTION

Many efforts have heretofore been made to provide equipment adapted to be used with the conventional aerosol type containers for shaving cream for dispensing the lather in heated condition. The surces of heat are usually hot water from the tap or electrical heating. The present invention utilizes the latter approach, but provides features of efficiency, economies in construction and operation, and neatness and ease of use which have not been available with prior art units.

One of the objects of the invention is to provide a heating and dispensing unit which rapidly rises to the proper temperature for heating the lather and is effectively controlled against over heating. This is accomplished by the use of a readily available off-the-shelf ceramic electric resistance heating element which quickly reaches and maintains the desired operating temperature. The flow of current to the heating element is controlled, but not by a thermostat sensitive to the heating element; instead, control is achieved by a simple and expensive timing switch in the circuit to the heating element located at a point remote from the element.

Another object of the invention is to provide a unit of the character described which is so constructed as to provide effective heating of the lather within the unit all the way to a point adjacent the point of discharge, and yet in which the prevention of leakage of hot lather or liquid into the electrical circuitry is easily and securely effected. A special feature of the invention resides in the provision of means for insuring that any steam generated by heating is effectively intercepted and mixed with the lather prior to discharge, thus maintaining a high quality lather and preventing any hot steam jets from striking the user. A related feature, from the standpoint of comfort and safety, is that the unit is so made as to avoid the creation of hot spots on the housing at the location where the fingers of the user might contact the housing during reception of the lather.

A further object of the invention is to provide a lather heating and dispensing unit which is constructed of a small number of parts, and which can be manufactured and made available to the public at relatively low cost.

Still another object of the invention is to provide a unit of the character described which lends itself particularly to use in situations where the shaving operation may be carried out at a location somwhat remote from the electric outlet and some minutes after detaching the unit from the electric outlet. The manner of construction of the unit is such as to store and preserve heat in the heating element, which heat remains available for heating lather to its desired temperature long after the unit has been disconnected from the source of electricity.

Other and further objects of the invention together with the features of novelty appurtenant thereto, will appear in the course of the following description.

DETAILED DESCRIPTION

In the accompanying drawings, which form a part of the specification and are to be read in conjunction therewith and in which like reference numerals indicate like parts in the various views.

Figure 2:
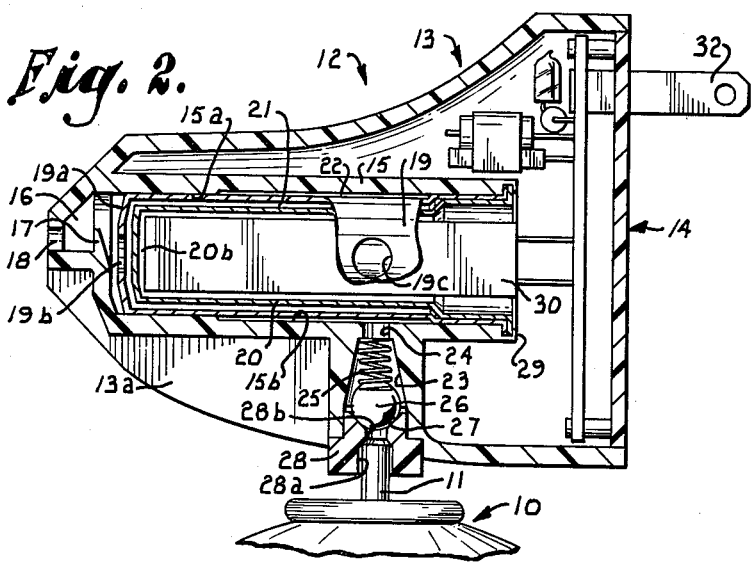
FIG. 2 is an enlarged vertical section through the preferred unit.

Referring now to the drawings and initially to FIG. 2, reference numeral 10 indicates the top portion of a conventional aerosol type container which has a discharge valve stem 11 extending from its upper end. As will be recognized by those skilled in the art, such containers with such valves are well known. The valve stem normally is of the type that when depressed, permits pressurized material in the container to discharge therethrough.

The heating and dispensing unit of the present invention is indicated generally by the reference numeral 12. Its general construction is in the form of a housing made up of two pieces; a forward or main housing portion 13 and a back plate 14. The housing is made of non-metallic material such as any of the currently used plastics, preferably one having low thermal conductivity and good heat resistance. The housing is an enclosed housing, the closure being formed by joining the plate 14 with the open end of the housing. The joint can be fused by sonic welding in the known manner.

The forward portion of the housing is generally hollow but, as can be seen best in FIG. 2, it has formed on its interior a cylindrical sleeve 15 which extends rearwardly from the forward wall and is formed integrally therewith. The sleeve is provided with a generally cylindrical bore 15*a* extending toward the front wall. The bore 15*a* communicates with an offset pocket or chamber 16 at the forward end which is defined in part by an upstanding lip 17 projecting above the center line of the bore 15*a*. A horizontal slot 18 is formed in the end wall of chamber 12 and it is this slot through which heated lather is dispensed during operation of the device.

The heating chamber for the lather is contained within the bore 15*a* of sleeve 15. In the preferred embodiment the heating chamber is made up by two concentric tubes, the outer one of which is indicated at 19 and the inner one at 20. The tubes are received in the bore with the outer tube in a tight press fit with the bore 15*a* of the sleeve.

The outer tube terminates at its forward end in an end closure 19*a* which has a central opening 19*b* confronting and spaced slightly away from the lip 17.

Proceeding from the rearward end of the tubes, they are each stepped down in diameter once, with the reduction being greater in the inner tube 20 thus to provide an annular chamber 21 between the inner tube and outer tubes. The forward end of the inner tube is closed as shown at 20*b*, and the closed end is spaced from the end wall of the outer tube in order that the annular space 24 merges into a space communicating with the outlet opening 19*b*.

The tubes 19 and 20 are constructed from a material having good heat conductivity, and preferably are thin walled aluminum tubes. Preferably the end wall 20*b* of the inner tube is made substantially greater in thickness than the side walls; this is for the purpose of retaining heat in the end wall so as to assure of continued heating of the dispensed material at the point of discharge from the heating chamber.

The sleeve 15 is provided with a counterbore 15*b* of somewhat greater diameter than the outside diameter of the outer tube 19. The counterbore 15*b* and the outer surface of tube 19 define an annular space 22 which is closed at both ends and which communicates with a side opening 19*c* in the outer tube.

The annular space 22 forms a passageway through which lather flows on its way from the container 10 to and through the primary heating chamber 21. The path from the container to the space 22 comprises a conical passageway 23 formed in the housing 13 below the sleeve. An opening 24 communicates between the passageway 23 and the annular flow space 22. The passageway 23 contains a compression spring 25 which engages the upper surface of a ball 26. The ball 26 seats in a conical seat 27 which is formed in an insert 28 extending into and secured to the lower end of the passageway 23. The insert 28 contains a socket 28*a* for reception of the stem 11 and a central bore 28*b* communicating with the bottom of the ball seat for flow of lather upwardly past the ball.

Figure 1:
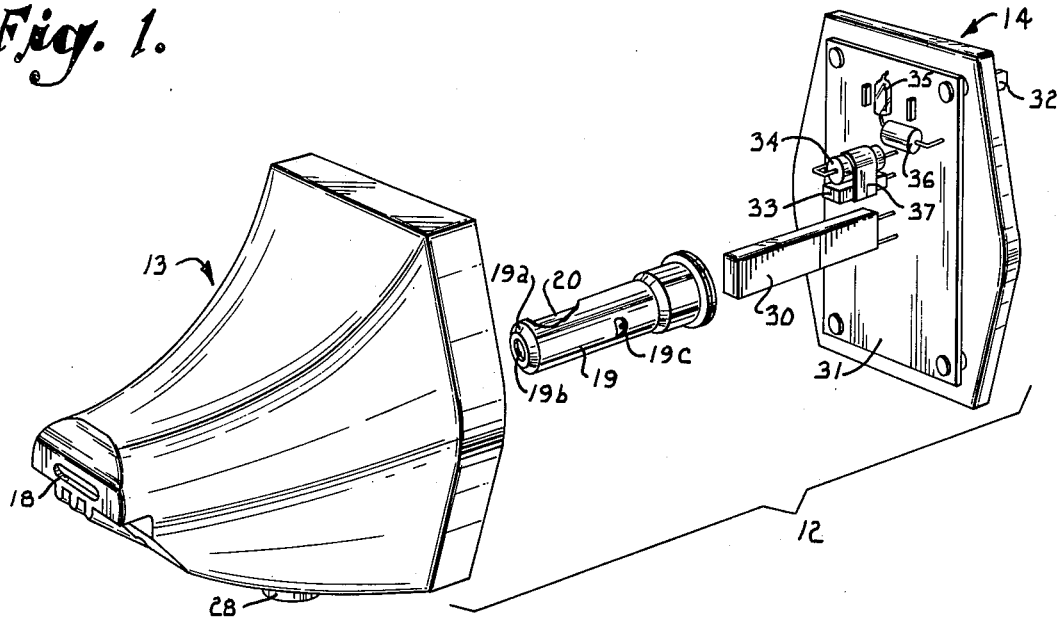
FIG. 1 is a perspective view of a preferred unit embodying the invention, many of the parts being shown in exploded relationship with one another.

The tubes 19 and 20 have out-turned flanges at their rearmost ends (right hand ends as viewed in FIGS. 1 and 2). These are engaged by a folded over annular lip 29 formed from the end of the sleeve 15 and engaging around the perimeters of the flanges to hold the tubes in place and to form a final seal separating any of the flow areas from the main interior of the housing.

It will be noted that the underside of the housing 13, in the area between the discharge outlet 18 and the stem receiving insert 28, is formed as a plurality of parallel ribs 13*a* which are separated by open grooves. The purpose of this is to provide for adequate ventilation of the surfaces adjacent or near the discharge opening so as to avoid formation of undersirable hot spots which might be touched by the user.

Inserted into the tube assembly from the open end is an electric heating element 30 which is in the form of a ceramic shell in which is embedded an appropriate heating element such as a nichrome wire heating element. The heating element is an off-the-shelf heating element which can be readily found in the rectangular form illustrated, as it is used in many appliances. The tube and heating element are so dimensioned that when inserted, the corners of the heating element will contact the interior wall of the inner tube and thus enhance the heat transfer from the element. In the preferred embodiment of the invention, I have employed a 325 ohm heating element.

The leads to the heating element are connected with a printed circuit board 31 which is mounted on the inside of the back plate 14 by any appropriate mounting means. The printed circuit board also carries the electrical components which provide the timing control and visual indications of condition which are part of the unit. The circuit board is connected with the spaced blade conductors 32 which are embedded in and extend outwardly from the back plate. The blade conductors are of the conventional type for reception in the ordinary wall electric outlet, and while only one is shown in FIGS. 1 and 2 it will be understood that two should be provided.

Figure 4:
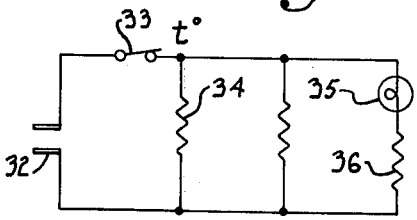
FIG. 4 is a schematic of the electric cicuitry.
Figure 3:
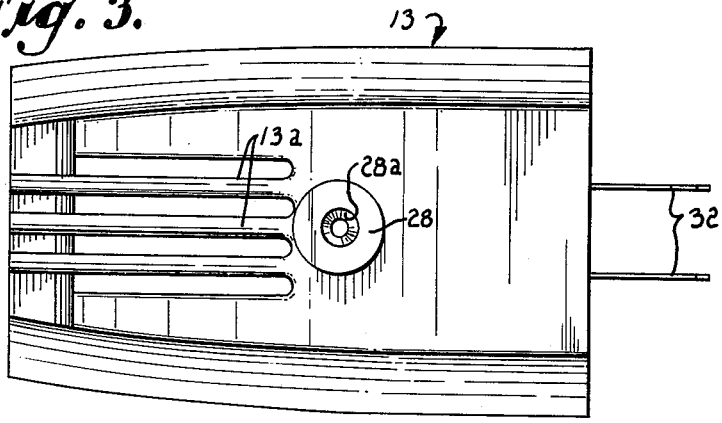
FIG. 3 is a bottom plan view of same.

Referring to the electric schematic in FIG. 4, it will be noted that an electric circuit served by blades 32 includes a thermostat 33, an adjacent resistor 34, a neon lamp 35, and a lamp resistor 36. The thermostat 33 and resistor 34 from in combination a timing control or switch for controlling the time during which the heating element 30 is energized following the initial insertion of the blades 32 in socket of an outlet.

If reference will again be made in FIGS. 1 and 2, the thermostat and resistor are shown as being in closely adjacent, abutting relationship. The thermostat 33 is a conventional bimetal blade type thermostat housed within a metal housing. The resistor 34 is a conventional resistor of small size. In the preferred embodiment, I utilize a thermostat having a break open point at 180° F, and a resistor of aproximately 4900 ohms. The resistor is attached to the casing of the thermostat by means of a strap or band 37 which is composed of aluminum thus to establish a fast heat transfer path from the body of the resistor to the case of the thermostat.

The lamp 35 is a conventional neon indicator lamp. It is so positioned that its light will be delivered to a portion of the rear plate 14, which preferably is made of translucent material so that the condition of the lamp, that is, whether lighted or not, can be observed by simply looking at the top of the back plate. Alternatively a sealed window can be provided in the casing.

The operation of the unit should be fairly evident from the foregoing description. To ready the unit for operation, the blades 32 are inserted in the conventional wall outlet jack so that electrical contact is made. The lamp 35 will be illuminated and current will flow to the heating element though the closed thermostat. The current is also being delivered to the small resistor 34 associated with the thermostat.

The circuit will remain on until such time as the temperature at the thermostat reaches the design "open contact" temperature, which in this specific embodiment is 180°. With the particular resistor disclosed, and with a 110 volt AC source, the time interval is approximately 1½ minutes. At the end of the 1½ minutes, the heat delivered by the resistor to the thermostat will cause the thermostat to open thereby shutting off the circuit and flow of current to the main heating element 30. At the same time the lamp 35 will extinguish and the unit will be ready for further operation.

The user then removes the unit from the wall to the location where it is desired to obtain the hot lather. It is important to note that because of the ceramic heating element, the ceramic material will act as a heat sink and store heat for a substantial period of time. The heating element will thus continue to transmit heat to the inner and outer tubes and provide heat to the chambers 21 and 22 for a substantial period after the heating element has been deenergized.

To obtain heating and dispensing of the lather the unit is placed on top of the container 10 with the insert socket 28*a* engaged with the top of the stem 11. Upon depression of the stem lather will flow upwardly through passageway 28*b* and will unseat the ball 26 sufficiently to flow on up into and through passageways 25 and 24 and into the annular space 22. The latter will expand into the space 22 and through the opening 19*c* into the primary heating chamber 21. The material rapidly fills chamber 21 and by continued flow and expansion flows out through the opening 19*b* of the outer tube. The discharging lather is deflected upwardly by the lip 17 and into the trap chamber 16, from whence it flows in ribbon form outwardly through the dispensing slot 18. Any free steam is mixed with the lather by the action of the lip 17 and trap chamber 16. The lather is heated during its travel through the annular space 22 and the heating chamber 21 and on through the space between the end walls 19*a* and 20*b* and arrives at the hand of the user in a well heated condition.

When the pressure is removed from the stem, flow of lather will stop. At the same time the ball 26 will reseat in order to block off any fow of material in the reverse direction down through passageway 28*b*. Thus any material trapped in the heating chamber, or any other interior part of the housing will not be permitted to run out through the inlet passageway 28*b*, and neatness and cleanliness, as well as safety, of the unit is provided.

From the foregoing it will be seen that this invention is now well adapted to attain all the ends and object hereinabove set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

Having thus described my invention, I claim:

1. Apparatus for heating and dispensing material from an aerosol type container having a projecting valve stem for discharge of the material from the container, said apparatus comprising a closed non-metallic housing provided with an integral internal tubular sleeve projecting from one inside wall, said sleeve terminating at the wall end thereof in a discharge opening to the exterior of the housing, means defining a heating chamber within said sleeve, said chamber including an annular portion having concentric inner and outer walls composed of material of high heat conductivity, said chamber communicating with said discharge opening, means defining a flow passageway through the wall of said housing and sleeve into said annular portion of said chamber for conducting material from said stem to said chamber, said flow passageway including a lateral opening through said sleeve, an annular space between the interior of the sleeve and the exterior of said outer wall of the heating chamber, and a lateral opening in the outer wall of the heating chamber, a heat storing electric resistance heating element located within said inner wall of said chamber for heating said chamber, and electric circuit means within the housing and connected with said heating element, said circuit means including connector members having portions extending externally of the housing for connection with an electric outlet.

2. Apparatus as in claim 1, said heating chamber having an outlet opening spaced from said discharge opening, and means for deflecting material emanating from said opening laterally and prior to its arrival at said discharge opening.

3. Apparatus as in claim 2, including a trap and mixing chamber between said deflecting means and said discharge opening.

4. Apparatus as in claim 1 wherein said electric circuit means includes a resettable timing switch remote from said heating element and chamber, and operable to open a cicuit to said heating element following the elapse of a predetermined time interval after the commencement of energization of the element.

* * * * *